United States Patent [19]

Camp

[11] Patent Number: 5,052,563

[45] Date of Patent: Oct. 1, 1991

[54] JEWELRY CADDY

[76] Inventor: Betty J. Camp, 3125 Mackay La., Shreveport, La. 71118

[21] Appl. No.: 421,991

[22] Filed: Oct. 16, 1989

Related U.S. Application Data

[63] Continuation-in-part of Ser. No. 375,679, Jul. 5, 1989.

[51] Int. Cl.[5] ..... A47F 7/00

[52] U.S. Cl. ..... 211/13; 211/163

[58] Field of Search ..... 211/13, 163, 205, 189, 211/113, 118, 60.1

[56] References Cited

U.S. PATENT DOCUMENTS

| | | | |
|---|---|---|---|
| 4,264,013 | 4/1981 | Vollmer | 211/13 |
| 4,322,007 | 3/1982 | Feibelman | 211/13 X |
| 4,776,650 | 10/1988 | Ferenzi | 211/13 X |

*Primary Examiner*—Alvin C. Chin-Shue
*Assistant Examiner*—Sarah A. Lechok
*Attorney, Agent, or Firm*—John M. Harrison

[57] ABSTRACT

A jewelry caddy which is characterized in a first preferred embodiment by a fixed or rotatable vase, a support rod or rods upward-standing from the base, an optional top strut frame attached to the top end of the support rod or rods and secured with a ring receptacle, a slat frame fitted over the support rod or rods and attached to the top strut frame and extending to a point above the base, and multiple, curved slats removably clipped to the slat frame and fitted with holes for mounting earrings thereon. The strut frame is characterized by spaced, horizontal, outwardly-extending, elongated struts having upward-turned tips for receiving such jewelry items as beads, rings and the like. In a first preferred aspect of the invention the slats are constructed of a resilient material having horizontal or slanted holes therein for receiving the earring posts. In a second preferred embodiment, a strip of foam rubber or like resilient material is attached to the inside concave surface of the curved slats to facilitate mounting a retainer on the post of the earrings when the post is projected through the holes. In other preferred embodiments, the jewelry caddy is provided with a bracket for mounting on a wall, a travel caddy design for closing like a book is also provided, as well as a jewelry box embodiment. In still other preferred embodiments, perforated slats are removably secured to slat mounts provided on brackets adapted for mounting on a wall and on horizontal post struts attached to vertical posts which are mounted on a tray fitted with a strut frame for supporting beads and the like and designed to receive such items as change, a watch, rings, a wallet and the like.

10 Claims, 3 Drawing Sheets

FIG. 14
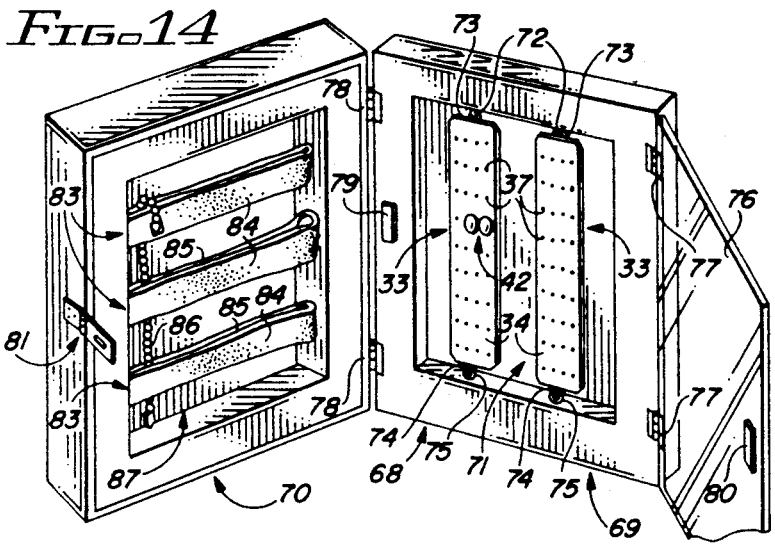
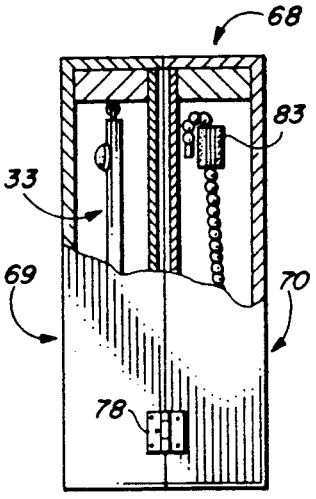
FIG. 16
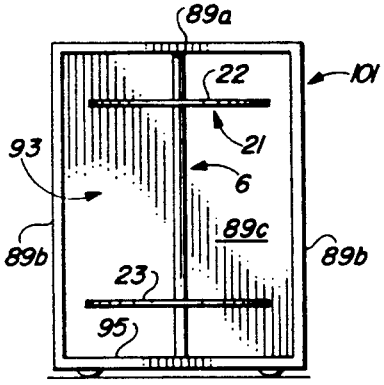
FIG. 19
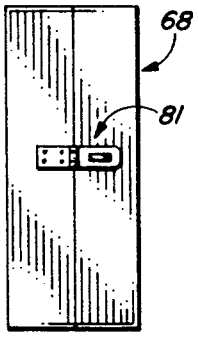
FIG. 15
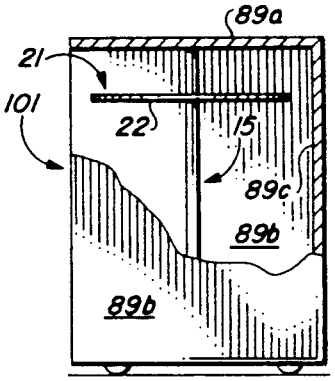
FIG. 20
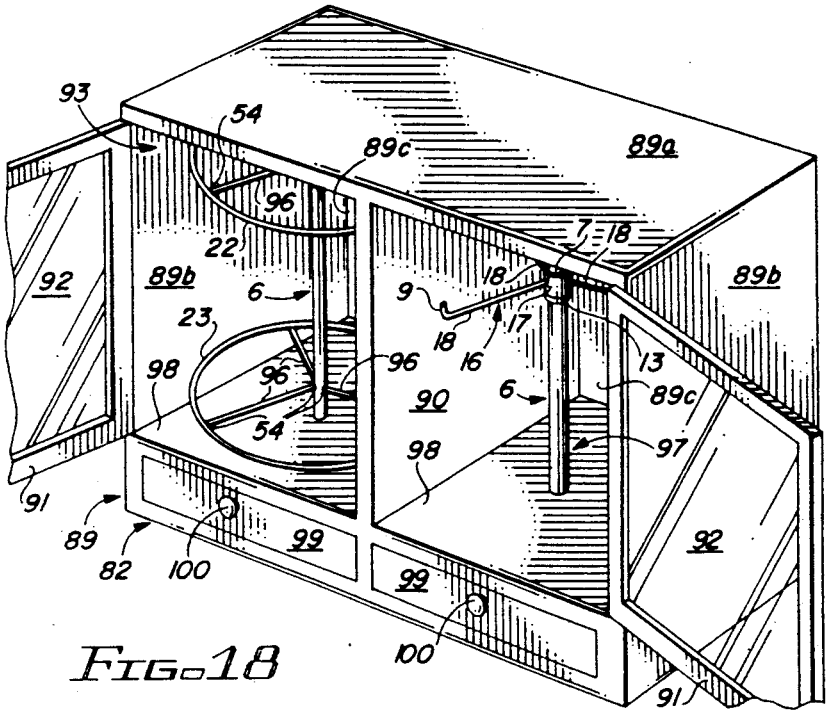
FIG. 18
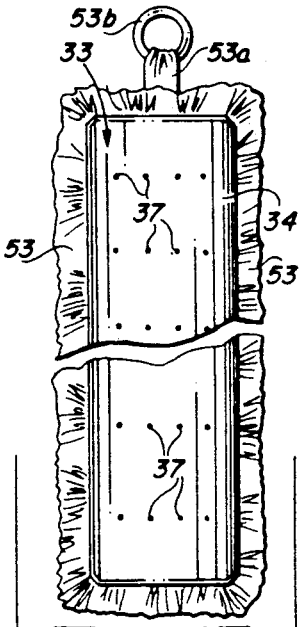
FIG. 17

JEWELRY CADDY

CROSS-REFERENCE TO RELATED APPLICATION

This application is a continuation-in-part of my copending U.S. Pat. application Ser. No. 07/375,679, filed July 5, 1989.

BACKGROUND OF THE INVENTION

1. Field of the Invention

This invention relates to devices for organizing and storing jewelry and more particularly, to a jewelry caddy which is characterized in a first preferred embodiment by a fixed or rotatable base for resting on a supporting object, one or more support rods upward-standing from the base and a top strut frame adapted for seating on the rod and having spaced, horizontal, outwardly-extending struts for receiving, supporting and organizing beads, rings and other jewelry. Further included is a slat frame resting on the top strut frame and having one or more horizontally spaced rings adapted to receive multiple, curved, perforated slats for receiving, supporting and organizing earrings, stick pins and similar jewelry. In a first preferred embodiment, the slats are constructed of a resilient material having horizontal or downwardly-slanted holes or perforations for receiving the earring posts and in a second preferred embodiment, a strip of soft material such as foam rubber or the like is attached to a stiff backing for mounting a retainer on the post when the post is inserted through one of the perforations. In another preferred embodiment, a bracket is provided on the support rod or rods for mounting the jewelry caddy on a wall, wherein the base is removed and a second strut frame is mounted to the bottom of the support rod to provide additional struts for supporting beads, rings and other jewelry. In other embodiments of the invention a travel caddy designed for receiving one or more slats and a jewelry box adapted for enclosing a jewelry caddy or caddies of this invention are provided. In still other preferred embodiments, a pair of spaced brackets are mounted to a wall and are fitted with one or more horizontal slat mounts for receiving the slats; vertical posts are secured to a tray for mounting the slats, a strut frame is mounted on the tray for supporting beads and the like and the tray is designed to receive such items as change, a watch, rings, a wallet and like items.

One of the problems realized in storing, displaying and organizing jewelry is that of providing a suitable jewelry container, enclosure or box which will adequately display the jewelry and organize it for easy selection when needed. Since various jewelry designs and colors should be worn in specific combinations with certain clothing, under normal circumstances the selection process frequently requires that all, or at least a part of the jewelry which is located in a conventional jewelry box be removed from the box. This selection technique is slow and laborious and must be undertaken each time the jewelry is worn.

2. Description of the Prior Art

Various types of jewelry caddies, organizers and racks are known in the art, including assorted racks and displays which have been developed for commercially displaying jewelry of various design. However, in most cases, jewelry which is kept at home is stored in a jewelry box, tray or other container that may be equipped with compartments, drawers and the like, in an attempt to organize the various jewelry pieces. U.S. Pat. No. 3,997,050, dated Dec. 14, 1976, to Chad W. Patterson, details a "Jewelry Caddy" which can be used to display jewelry, both commercially and privately. The jewelry caddy includes a base structure having an upstanding, rotating element which is fitted with multiple projections adapted to hold articles of jewelry. A layer of soft material such as cork, which can be easily penetrated by a needle or a pin, covers at least a portion of the surface of the upstanding element, whereby jewelry or other items having pin-type attachments can be pinned to the material for convenient display and storage. A similar "Display Device" is detailed in U.S. Pat. No. 4,040,520, dated Aug. 9, 1977, to Gene Joaquin. The device is designed to display relatively small articles and includes a wedge-shaped support having multiple exterior faces, each having support means for holding a removable display board. Each board is adapted to be pre-loaded with articles to be displayed before being installed on a face of the support, which is mountable on a rotatable base. U.S. Pat. No. 4,253,576, dated Mar. 3, 1981, to Allan L. Ford, details a "Belt Fixture and Method of Using Same". The belt fixture includes a rack having multiple segments, each segment of which includes multiple, horizontally-extending spokes. The segments further include color indicia, with the color of each segment being different from the colors of the other segments. Belts are suspended by hang tags, which are releasably placed on the spokes. The hang tags have the same color as the color applied to its associated segment and the colors are used to segregate belts on the rack, by style. A "Theft-Preventive Jewelry Display Stand" is detailed in U.S. Pat. No. 4,463,856, dated Aug. 7, 1984, to Andy Strasser. The jewelry display stand includes multiple, substantial vertical, rectangular side panels of equal height connected to each other at their vertical edges and mounted on and secured to a preferably circular, flat bottom piece. One of the side panels may be a mirror panel, but at least one of the side panels is also a display panel having multiple, vertically-oriented display arms extending perpendicularly therefrom, parallel to the vertical edges of the display panel. Adjacent display arms contain opposing vertical slots running the length of the display arms. The slots are of such depth that rectangular jewelry display cards having earrings and the like attached thereto may be slidably mounted and held on the display panel. The jewelry display stand is also provided with a detachable, decorative lid which is designed to cover the top of the side panels and vertical slots are included to prevent theft of jewelry mounted on the display cards. The jewelry display stand may be made rotatable by attaching the bottom piece to a rotatable base. U.S. Pat. No. 4,480,755, dated Nov. 6, 1984, to Jerry G. Cartwright, details a "Tool Storage Device". The tool storage device includes a cabinet having multiple, vertically-arranged, planar side walls, each containing multiple apertures adapted to receive a portion of a support hook. The cabinet also includes an internal assembly for locking the hook portions within the apertures to provide a stable support for hand tools and the like. The locking assembly includes multiple locking plates arranged in parallel, spaced relationship with respect to the cabinet side walls, respectively, and a rotatable cam for displacing the locking plates relative to the side walls between locked positions, in which the locking plates press the hook portions against the inner surfaces of the associated side walls, respectively, and unlocked positions, in which the locking plates release the hook portions, respectively.

It is an object of this invention to provide a jewelry organizer and caddy which includes a base, at least one support rod upward-standing from the base and a slat frame supported by the support rod or rods and adapted to receive multiple, curved slats provided with holes for receiving, mounting and displaying earrings.

Another object of this invention to provide a new and improved jewelry caddy which is characterized by a base, one or more support rods extending upwardly from the base, at least one strut frame attached to the support rod or rods and extending therefrom for receiving beads, rings and other jewelry and further including at least one circular frame member supported by the strut frame and multiple slats removably secured to the frame member or members and provided with openings for receiving earrings and other jewelry in removable relationship.

Still another object of the invention is to provide a new and improved jewelry caddy which includes a rotatable base member, a support rod vertically upward-standing from the center of the base member, a strut frame secured to the support rod and having radially outwardly-extending struts for mounting beads, rings and other items of jewelry thereon, a slat frame provided with one or more frame rings supported by the strut frame and a plurality of slats removably mounted on the frame ring or rings and provided with openings for receiving, mounting and organizing earrings and other pieces of jewelry.

Yet another object of this invention is to provide a jewelry caddy which is characterized by one or more vertically-oriented rods with top and bottom strut frames mounted thereon, which strut frames each have radially-extending struts for supporting beads, rings and other jewelry, a pair of frame rings disposed on the rods and attached to the strut frames and designed to receive multiple, curved slats, which slats are perforated in a desired pattern for receiving and mounting earrings thereon and further including a bracket attached to the rod or rods for mounting the jewelry caddy on a wall.

Another object of this invention is to provide a travel caddy adapted to open and close like a book and receive one or more perforated slats and loop-pile fasteners for receiving, mounting and securing jewelry such as earrings and beads.

A still further object of the invention is to provide a jewelry caddy having a tray for receiving such items as change, a watch, a wallet and the like, a rotatable strut frame attached to the tray and vertical, spaced posts mounted on the tray, along with at least one horizontal strut connecting the posts for supporting multiple, perforated slats adapted to receive and mount earrings thereon.

Another object of this invention is to provide a wall-mounted jewelry caddy which includes a pair of spaced brackets adapted for mounting on a wall and spaced rods or struts connecting the brackets in parallel relationship for receiving perforated slats and mounting earrings on the slats.

Yet another object of this invention is to provide a single or dual-compartment jewelry caddy which is characterized by a box-like enclosure having an optional drawer or drawers and one or more compartments for receiving a support rod and frame rings and mounting slats thereon and a support rod and strut frame, respectively. Jewelry is stored in the drawers, attached to the slats and placed on the strut frame for storage and display.

SUMMARY OF THE INVENTION

These and other objects of the invention are provided in a new and improved jewelry caddy and organizer which is characterized in a first preferred embodiment by a rotatable or fixed base and one or more support rods extending vertically from the base. A top strut frame is attached to the upper end of the support rod or rods and includes one or more horizontal, radially-oriented struts for hanging or supporting beads, rings and similar items of jewelry and an upward-standing, tapered cap nut may be threaded on the upper end of one or more of the support rods to receive a watch or ring and retain the strut frame on the support rod or rods. A slat frame having one or more horizontally-disposed, circular rings is mounted on the strut frame and multiple, curved, perforated slats are removably clipped to the rings for receiving earrings and other jewelry pieces. In another preferred embodiment of the invention a bottom strut frame replaces the jewelry caddy base on the lower end of the support rod or rods and a bracket is mounted on the support rod or rods for securing the jewelry caddy on a wall. In a third preferred embodiment, a travel caddy is characterized by a book-like enclosure fitted with one or more perforated slats and provided with at least one loop-pile fastener for securing beads and other jewelry in the caddy. A jewelry box embodiment of the jewelry caddy is also provided and includes a container for one or more support rod and strut frame combinations. In other embodiments, a tray is designed for receiving change, a wallet, a watch and the like, and is provided with upward-standing, spaced posts connected by a pair of horizontal post struts for receiving multiple, perforated slats and organizing earrings and other jewelry. The tray may be replaced by spaced brackets for mounting on a wall and joined by one or more slat mounts for receiving the slats.

BRIEF DESCRIPTION OF THE DRAWINGS

The invention will be better understood by reference to the accompanying drawings, wherein:

FIG. 14 is a perspective view of a travel jewelry caddy embodiment of the invention;

FIG. 15 is a front view of the travel jewelry caddy in closed configuration;

FIG. 16 is a rear view, partially in section, of the travel jewelry caddy illustrated in FIGS. 14 and 15;

FIG. 17 is a front view of a decorative slat element;

FIG. 18 is a perspective view of a dual-compartment jewelry box embodiment of the jewelry caddy of this invention;

FIG. 19 is an alternative single-compartment embodiment of the jewelry box illustrated in FIG. 18; and FIG. 20 is a side view, partially in section, of the single-compartment jewelry box embodiment illustrated in FIG. 19.

DESCRIPTION OF THE PREFERRED EMBODIMENTS

Figure 1:
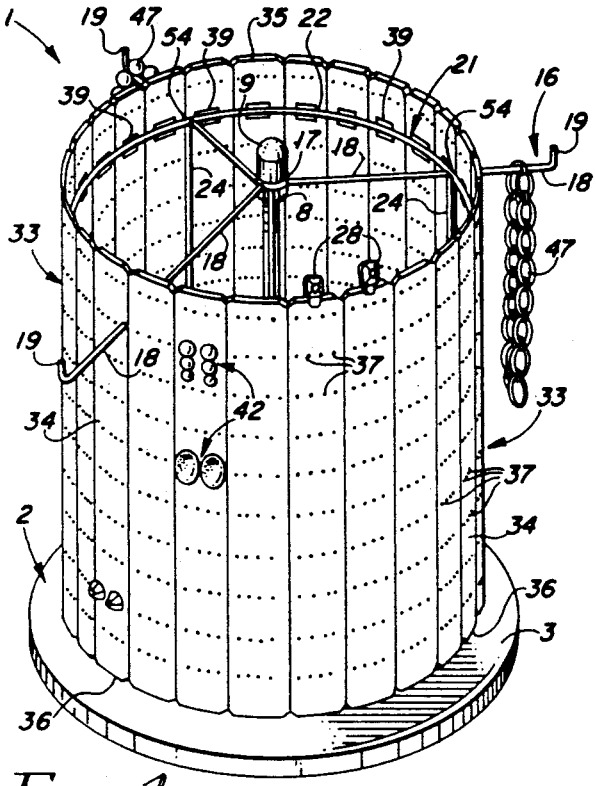
FIG. 1 is a perspective view of a first preferred embodiment of the jewelry caddy of this invention.
Figure 4:
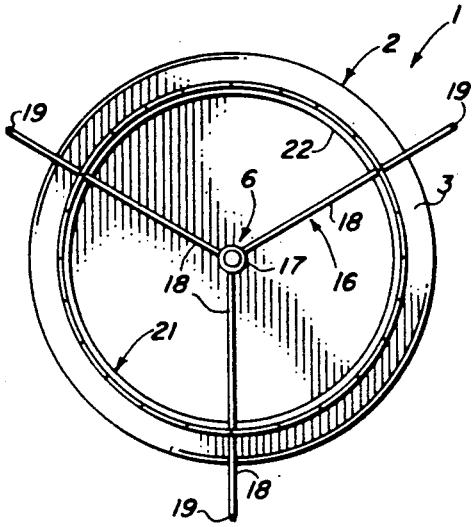
FIG. 4 is a top view of the jewelry caddy illustrated in FIG. 1 with the cap nut removed.
Figure 2:
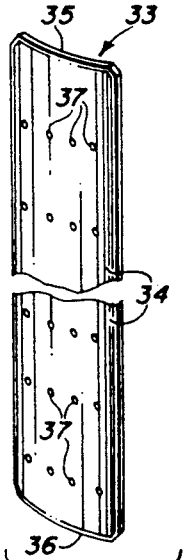
FIG. 2 is a perspective view of the outside surface of a preferred perforated slat element of the jewelry caddy illustrated in FIG. 1.
Figure 6:
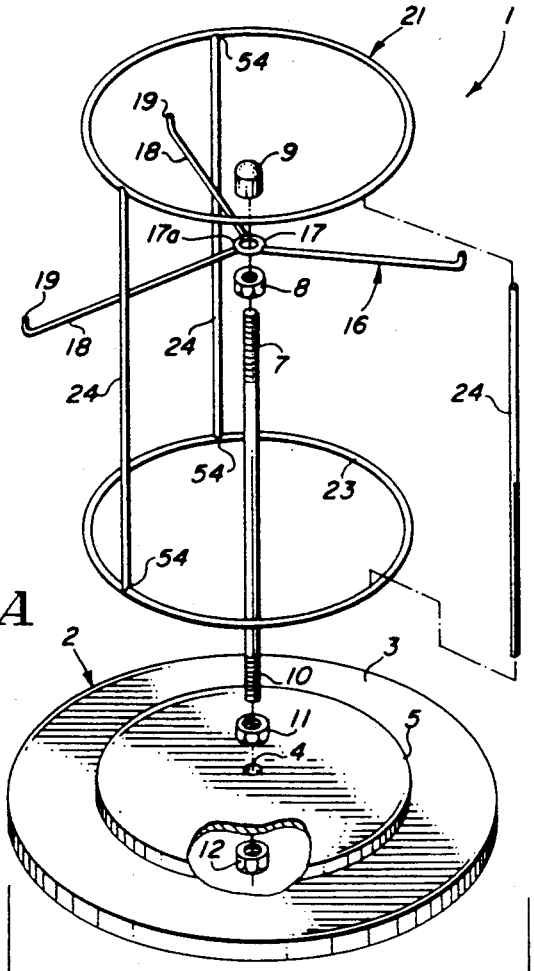
FIG. 6 is an exploded view of the base, support rod, slat frame and strut frame elements of the jewelry caddy illustrated in FIGS. 1 and 4.

Referring initially to FIGS. 1, 4, 6 and 6A of the drawings, a first preferred embodiment of the jewelry caddy of this invention is generally illustrated by reference numeral 1. The jewelry caddy 1 is characterized by a circular base 2, having a flat base plate 3, which is provided with a base plate shoulder 5 and having a base plate opening 4 in the center thereof, as illustrated in FIG. 6. An elongated support rod 6 is provided with top rod threads 7 on the top end thereof and bottom rod threads 10 on the bottom end, which bottom end of the support rod 6 is designed to receive a bottom nut 11 on the bottom rod threads 10 and then to extend through the base plate opening 4 and receive a bottom lock nut 12 on the extending portion of the bottom rod threads 10, as illustrated in FIG. 6. Accordingly, it will be appreciated that the support rod 6 can be made rotatable with respect to the base 2 by loosening the bottom nut 11 or the bottom lock nut 12, as desired. Alternatively, the base 2 itself may be rotatable, as hereinafter further described. A top nut 8 is first threaded on the top rod threads 7 and the top strut ring 17 of a top strut frame 16 is then inserted over the top end of the support rod 6, such that the top end of the support rod 6 extends through the top ring opening 17*a* of the top strut ring 17, as further illustrated in FIG. 6. The top strut frame 16 is further characterized by three top struts 18, which extend radially outwardly from the top strut ring 17 and the top struts 18 are each terminated by an upward-turned top strut tip 19. A slat frame 21 is characterized by a top frame ring 22 and a bottom frame ring 23, each welded at the welds 54 to the top ends of three frame supports 24, respectively, which orient the top frame 22 and bottom frame ring 23 in spaced relationship, as further illustrated in FIG. 6. The bottom ends of the frame supports 24 are welded at additional welds 54 to the bottom frame ring 23 in spaced relationship, to facilitate spacing the top frame ring 22 and the bottom frame ring 23. Accordingly, as further illustrated in FIGS. 1 and 6, the bottom frame ring 23 is suspended above and in circular alignment with the base plate shoulder 5 of the base 2, while the top frame ring 22 rests on the top struts 18 of the top strut frame 16, as illustrated in FIGS. 1, 4 and 6. The top frame ring 22 may be welded at the welds 54, or otherwise attached to the top struts 18, as desired, in order to stabilize the slat frame 21 on the top strut frame 16. A bullet-shaped cap nut 9 is threadably attached to the top rod threads 7 which extend through the top ring opening 17*a* of the top strut ring 17, in order to secure the top strut frame 16 on the support rod 6, as further illustrated in FIG. 1. Alternatively, the cap nut 9 may be welded to, or formed integrally with, the top strut ring 17 and the entire top strut frame 16 threadably mounted on the top rod threads 7 of the support rod 6, as a unit. Alternatively, the mount base 56 of a ring mount 55, illustrated in FIG. 6A, may be threaded on the end of the top rod threads 7, to orient the tapered ring cone 57 upward for receiving the ring 58.

Figure 3:
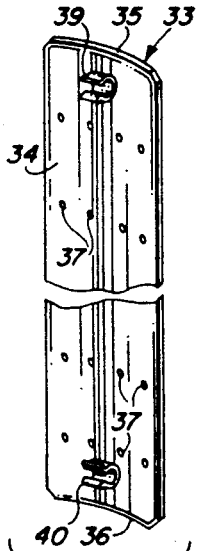
FIG. 3 is a perspective view of the inside surface of the slat element illustrated in FIG. 2.
Figure 6A:
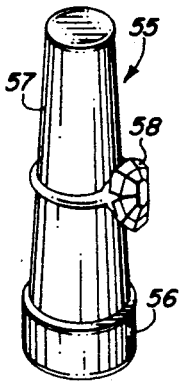
FIG. 6A is a perspective view of a ring mount adaptable for replacing the cap nut element of the jewelry caddy illustrated in FIGS. 1 and 6.
Figure 5:
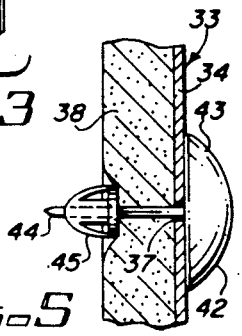
FIG. 5 is a sectional view of an alternative slat element.

Referring now to FIGS. 1-5 of the drawings, the curved slat plates 34 of each of the slats 33 are provided with a top clip 39 and a bottom clip 40, as illustrated in FIG. 3, for removable attachment to the top frame ring 22 and the bottom frame ring 23 of the slat frame 21, respectively, as illustrated in FIG. 1. Each of the slat plates 34 is terminated at the top by a top plate margin 35, which removably receives and seats clip-on earrings 28, as illustrated in FIG. 1, and at the bottom by a bottom plate margin 36. Multiple slat holes 37 are provided in the slat plates 34, in order to receive the posts 44 of pierced-ear earrings 42 and facilitate display of the decorative elements 43 of the pierced-ear earrings 42, by inserting a retainer 45 on the post 44, as illustrated in FIG. 5. In a preferred embodiment of the invention a resilient foam backing 38 of desired thickness may be attached to the concave surface of each of the slat plates 34, in order to facilitate secure, but removable, seating of the retainer 45 on the post 44 of each of the pierced-ear earrings 42 and fitting of the decorative element 43 of the pierced-ear earrings 42 against the outside surface of the slat plate 34, as illustrated in FIG. 5. Alternatively, the slat plates 34 may be injection-molded from a suitable plastic material or otherwise constructed of a resilient material in a thickness which is suitable for receiving the post 44 of a pierced ear earring 42 and engaging the retainer 45 with the post 44, as illustrated in FIG. 3. As further illustrated in FIG. 1, the horizontally-disposed, outwardly-extending top struts 18, provided in the top strut frame 16, are designed to receive and support one or more strands of beads 47, as well as rings, broaches, clasps and other items of jewelry (not illustrated). In addition, the upward-standing bullet-shaped cap nut 9 may be used to support a watch, ring or other item of jewelry, as desired.

It will be further appreciated from a consideration of FIGS. 1-5 of the drawings that any desired number of spaced slat holes 37 can be provided in the slat plates 34 in any spatial orientation to present the pierced-ear earrings in a desired orientation on the jewelry caddy 1. Furthermore, as heretofore discussed, the slat plates 34 can be constructed of a resilient plastic or a stiffer plastic, such as "Plexiglass", as well as wood, metal, porcelain, leather, nylon or fiberglass, in non-exclusive particular, in any desired thickness, with or without the foam backing 38, in order to receive as many sets of the pierced-ear earrings 42 as desired. Moreover, while the top strut frame 16 is illustrated with three outwardly-extending, radial top struts 18, it will be further understood that more or fewer top struts 18 can be extended from the top strut ring 17 in a top strut frame 16, depending upon the number of strings of beads 47, rings (not illustrated) and other jewelry which must be supported by the top strut frame 16. Additionally, the top struts 18 may be terminated at the top frame ring 22 under circumstances where it is desired to use the top strut frame 16 only to support the slat frame 21 and not for the purpose of supporting jewelry items such as beads and the like.

Figure 7:
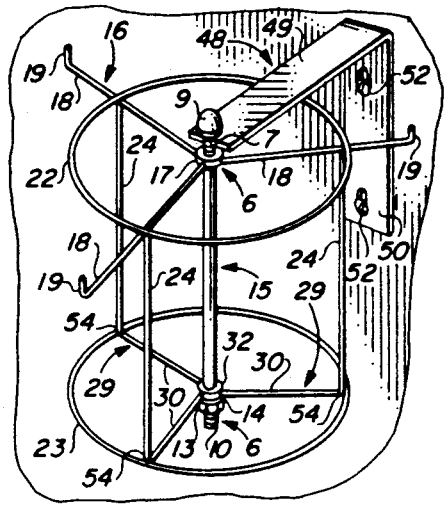
FIG. 7 is a perspective view of an alternative preferred embodiment of the jewelry caddy illustrated in FIG. 1, with a bottom strut frame replacing the base and further including a bracket for supporting the jewelry caddy on a wall.

Referring now to FIGS. 2–5 and 7 of the drawings, in another preferred embodiment of the invention the base 2 is removed from the jewelry caddy 1 and a bottom strut frame 29 is substituted therefor, which bottom strut frame 29 is further characterized by a bottom strut ring 32, having a bottom ring opening (not illustrated) for receiving the support rod 6. Three horizontal bottom struts 30 extend radially from fixed attachment to, or integral formation with, the bottom strut ring 32. An L-shaped bracket 48 is characterized by a horizontal leg 49, having a horizontal leg opening (not illustrated), therein for insertion on the top end of the support rod 6 and threadable mounting on the top rod threads 7 of the support rod 6 by means of the cap nut 9. The downwardly-turned vertical leg 50 of the bracket 48 extends from the opposite end of the horizontal leg 49 and is characterized by spaced, key slot mount openings 52, for receiving fasteners (not illustrated) and mounting the bracket 48 to a wall or other support (not illustrated). In another preferred embodiment of the invention, the bottom strut frame 29 is mounted to the bottom end of the support rod 6 by means of a washer 14 and a bottom cap nut 13, which threadably engages the bottom rod threads 10, located on the bottom end of the support rod 6. A rod sleeve 15 is seated over the support rod 6 between the top strut ring 17 of the top strut frame 16 and the bottom strut ring 32 of the bottom strut frame 29, respectively, to allow firm seating of the top strut ring 17 and the bottom strut ring 32 on the support rod 6 when the jewelry caddy 1 is assembled, as illustrated in FIG. 7.

Figure 8:
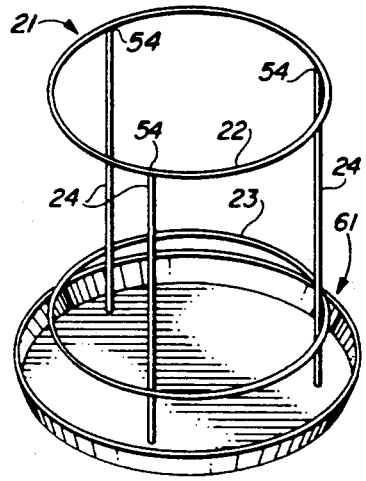
FIG. 8 is a perspective view of yet another preferred embodiment of the jewelry caddy of this invention.

Referring now to FIG. 8 of the drawing, another preferred embodiment of the jewelry caddy of this invention is illustrated and includes a dish-shaped base 61 which may be fixed or rotatable, as hereinafter described. A slat frame 21 extends from the dish-shaped base 61 and the slat frame 21 includes three equally spaced, vertical frame supports 24, one end of each of which is mounted in the dish-shaped base 61 and the other ends of which are welded by means of welds 54 to a top frame ring 22 in spaced relationship. A bottom frame ring 23 is also welded by means of welds 54 to the frame supports 24 in spaced relationship with respect to the top frame ring 22 and multiple slats 33 (illustrated in FIGS. 1–3) can be attached to the top frame ring 22 and the bottom frame ring 23 to complete the jewelry caddy.

Figure 9:
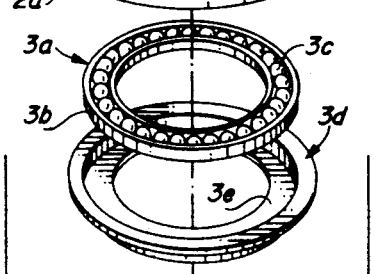
FIG. 9 is a perspective, exploded view of still another preferred embodiment of the jewelry caddy, more particularly illustrating a preferred rotatable base design.

Referring now to FIG. 9 of the drawings, in another preferred embodiment of the invention the jewelry caddy illustrated in FIG. 8 is provided with a top strut frame 16, characterized by spaced top struts 18, secured at one end to a top strut ring 17, which receives a ring mount 55. The opposite ends of the top struts 18 are upward-turned to define top strut tips 19 and an optional center opening 60 is provided in the center of the base cap **2*a* of the base 2. In a most preferred embodiment of the invention the base cap 2*a* receives a base bearing 3*a*, provided with multiple base bearings 3*c*, mounted in a bearing race 3*b*. The base bearing 3*a* fits in a base bearing ring 3*d*, which includes a bearing support 3*e*. Accordingly, when the base bearing ring 3*d* receives the base bearing 3*a* and is mounted in the base cap 2*a* of the base 2, the base cap 2*a* is rotatable with respect to the base bearing ring 3*d*, as the base bearings 3*c* traverse the bearing race 3*b* and the bearing support 3*e***.

Figure 11:
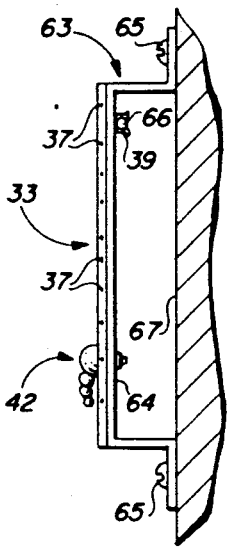
FIG. 11 is a left side view of the wall-mounted jewelry caddy illustrated in FIG. 10.
Figure 10:
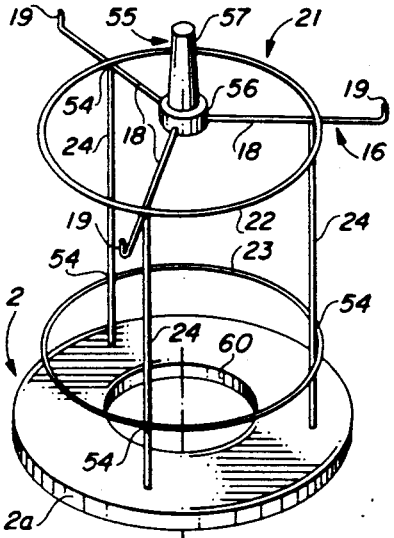
FIG. 10 is a perspective view of a wall-mounted embodiment of the jewelry caddy.
Figure 10:
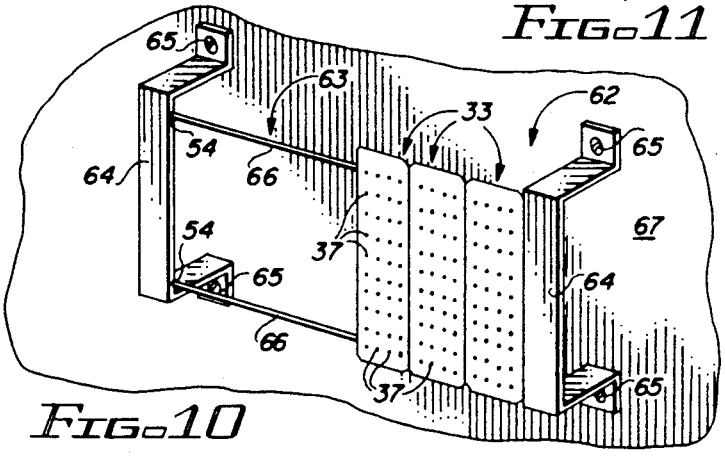

Referring now to FIGS. 10 and 11 of the drawings, in another preferred embodiment of the invention a wall caddy 62 is illustrated. The wall caddy 62 is characterized by a wall frame 63, which includes a pair of spaced, U-shaped frame legs 64, joined by horizontal, parallel slat mounts 66, the ends of which slat mounts 66 are welded to the frame legs 64 at the welds 54. The ends of the frame legs 64 are flattened and secured to a flat wall 67 by means of four leg fasteners 65. As illustrated in FIG. 3, the top clip 39 and bottom clip 40 of several slats 33 are secured to the parallel slat mounts 66, in order to secure the slats 33 on the slat mounts 66 in perpendicular relationship, as illustrated in FIG. 10. Earrings and other jewelry can then be mounted on the slats 33 in the same manner as heretofore described.

Figure 12:
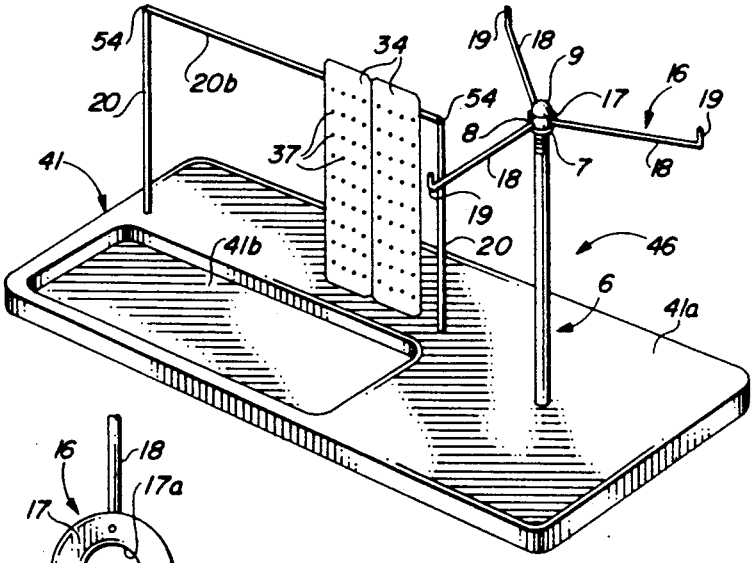
FIG. 12 is a perspective view of a tray jewelry caddy embodiment.
Figure 13:
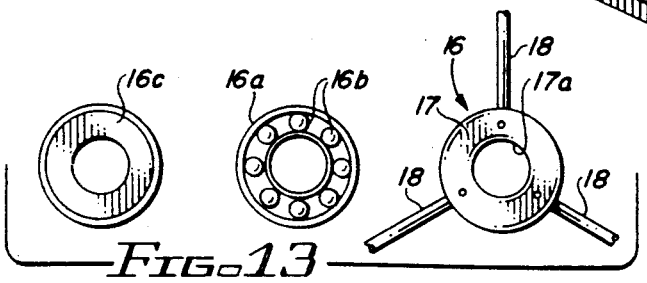
FIG. 13 is a top view, partially in section, of a preferred bearing mount for a top strut frame element of the tray jewelry caddy illustrated in FIG. 12.

In yet another preferred embodiment of the invention, and as illustrated in FIGS. 12 and 13, a tray caddy 46 is characterized by a tray 41, having a flat top surface for mounting one end of a pair of parallel slat posts 20. A recess **41*b* is provided in the tray 41 for securing such items as change, a watch, wallet and the like. A post strut 20*b* extends horizontally between the vertical slot posts 20 and is attached thereto by welds 54 for removably receiving the top clips 39, attached to each of the slat plates 34 of the slats 33, as illustrated in FIG. 3. Alternatively, the slat posts 20 and post struts 20*b* can be fabricated in one piece, as desired. Accordingly, various items of jewelry such as rings, a watch and the like, as well as change, a wallet, sunglasses and other pocket items can be located in the recess 41*b* of the tray 41, while clip-on earrings and pierced-ear earrings (not illustrated) are mounted on the slat plates 34 of the slats 33. While the curved slats 33 may be implemented in the tray caddy 46 as described above, it will be appreciated that other slats (not illustrated), having slat plates which are flat may also be mounted on the post strut 20*b*, since the post strut 20*b* is not horizontally curved, but presents a flat mounting surface. An optional top strut frame 16 is pivotally mounted by means of a top strut ring 17, fitted with a frame bearing ring 16*a*, containing frame bearings 16*b* seated in a frame bearing race 16*c*, to the top end of a support rod 6. Three top struts 18, having upward-turned top strut tips 19, are secured to the top strut ring 1. The top strut 17 is pivotally secured to the support rod 6 by means of a top nut 8 and a cap nut 9, both threaded on the top rod threads 7**.

Referring now to FIGS. 14–16 of the drawings, a travel case jewelry caddy is illustrated and includes a right-hand compartment 69 and a left-hand compartment 70, joined at the edges by a pair of compartment hinges 78. The right-hand compartment 69 is further characterized by a slat recess 71, provided with spaced top hook eyes 73 and bottom hook eyes 75, which are positioned to receive a pair of slats 33 by means of corresponding top hooks 72 and bottom hooks 74, attached to the slats 33, which engage the top hook eyes 73 and the bottom hook eyes 75, respectively. In a preferred embodiment of the invention a transparent glass or plastic right-hand cover 76 is attached to the outside edge of the right-hand compartment 69 by means of a pair of cover hinges 77 and is fitted with a receiver plate 80 which engages a magnet 79, mounted in the opposite face of the right-hand compartment 69 from the cover hinges 77, to close the slat recess 71. Accordingly, the transparent right-hand cover 76 can be closed over the recessed slats 33 by engaging the receiver plate 80 with the magnet 79 to retain one or more sets of pierced ear earrings 42 inside the slat recess 71, on the slats 33. Similarly, the left-hand compartment 70 is provided with a necklace recess 87 and may also include a hinged transparent cover (not illustrated), in the same manner as the right-hand cover 76. The necklace recess 87 receives a pair of loop-pile fasteners 83, which include a loop element 84, closed on a pile element 85, with a necklace 86 sandwiched therebetween for removably enclosing the necklace inside the necklace recess 87. Accordingly, it will be appreciated that the travel case jewelry caddy 68 can be closed, secured by the closure 81, as illustrated in FIGS. 15 and 16, and utilized to carry various assorted jewelry, using both the slats 33 and the loop-pile fasteners 83.

As illustrated in FIG. 17, a single slat 33 is fitted with a ruffle 53, a mount loop **53*a* and a mount ring 53*b* provided on the mount loop 53*a*, for securing pierced ear earrings 42 and clasp-type, or clip-on earrings 28 to the slat plate 34, as heretofore described with respect to the jewelry caddy 1 illustrated in FIG. 1**.

Referring now to FIG. 18 of the drawings, in another preferred embodiment of the invention, a dual compartment jewelry caddy 82 is illustrated and includes an enclosure having a top panel **89*a*, side panels 89*b* and a rear panel 89*c*, which enclosure is closed by doors 91, having glass or plastic panels 92. Drawers 99, having drawer pulls 100, are provided in the lower front of the dual compartment jewelry caddy 82 and a divider 90 defines a slat frame compartment 93 and a strut frame compartment 97 above the drawers 99. The slat frame compartment 93 encloses a slat frame 21, which is characterized by a vertically oriented support rod 6, the ends of which are fixed or rotatably mounted in the slat frame compartment base 95 and the top panel 89*a*, respectively. Ring spokes 96 extend from the top and bottom segments of the support rod 6 and a top frame ring 22 is mounted on the top ones of the ring spokes 96, while a bottom frame ring 23 is secured to the bottom ones of the ring spokes 96. In a most preferred embodiment of the invention, both the top frame ring 22 and the bottom frame ring 23, as well as the respective ring spokes 96 are constructed of metal and the ring spokes 96 are welded to the top frame ring 22 and the bottom frame ring 23 and to the support rod 6 by means of welds 54, as illustrated. It will be appreciated by those skilled in the art that the support rod 6 may either be fixed in the slat frame compartment 93 or it may be rotatably mounted in the slat frame compartment base 95 and the top panel 89*a*, according to the knowledge of those skilled in the art. Another support rod 6 is rotatably or fixedly mounted in the strut frame compartment 97 between the strut frame compartment base 98 and the top panel 89*a* and includes a top strut frame 16. The top strut frame 16 is further characterized by three top struts 18, projecting outwardly from a central top strut ring 17, which is rotatably mounted on the support rod 6 by means of a washer 14 and a companion bottom cap nut 13, threadably secured to the top rod threads 7 provided on the support rod 6. Alternatively, it will be appreciated by those skilled in the art that the top strut ring 17 can be fixed to the support rod 6 in non-rotatable relationship, as desired. In a most preferred embodiment of the invention, upward-standing top strut tips 19 are provided on the extending ends of the top struts 18 for purposes which have been heretofore described. Slats 33 may be mounted on the top frame ring 22 and bottom frame ring 23, as illustrated in FIG. 1, and jewelry can be secured to the slats 33 and the top strut frame 16**, for storage and display, as further heretofore described.

Referring now to FIGS. 19 and 20 of the drawings, in another preferred embodiment of the invention a single compartment jewelry caddy 101 is illustrated, for containing the support rod and slat frame 21 structure illustrated in FIG. 18. The single compartment jewelry caddy 101 may be provided with a door which is omitted for brevity in the drawing.

It will be appreciated from a consideration of FIGS. 1–4, 6 and 7–12 of the drawings that each of the slats 33 may be quickly and easily removed from and inserted on the top frame ring 22 and bottom frame ring 23 of the slat frame 21 illustrated in FIGS. 1, 6 and 7–9, the slat mounts 66 illustrated in FIG. 10 and the post struts **20*b* illustrated in FIG. 12, in order to removably mount, display and remove various sets of pierced-ear earrings 42 and clip-on earrings 28. Accordingly, when it is desired to attach a set of pierced-ear earrings 42 to a selected one of the slats 33, the slat 33 is grasped near the top plate margin 35 and outward finger pressure on the slat plate 34 disengages the top clip 39 and the bottom clip 40 from the respective top ring 22 and bottom frame ring 23 or the slat mounts 66 and the post strut 20*b*, respectively, to facilitate insertion of the post 44 through a selected one of the slat holes 37 in the slat plate 34 and through the optional foam backing 38. The retainer 45 is then clipped to the end of the post 44, as illustrated in FIG. 5 and the top clip 39 and bottom clip 40 are again inserted on the top frame ring 22 and bottom frame ring 23, respectively, of the slat frame 21, as illustrated in FIG. 1, or on the slat mounts 66 of the wall caddy 62 or the post strut 20*b* of the tray caddy 46, as applicable. Furthermore, the clip-on earrings 28 are easily clipped directly to the top plate margins 35 of the slat plates 34 and various assortments of beads 47 may be conveniently suspended from the top struts 18 of the top strut frame 16, while the upward-turned top strut tips 19 prevent the beads 47 from inadvertently falling from the top struts 18. In addition, rings, broaches, clasps and other items of jewelry which are susceptible of suspension on the top struts 18 may also be arranged thereon. Moreover, as noted above, a watch or ring may be placed on the bullet-shaped cap nut 9, or on the ring core 57 of the ring mount 55**, as desired.

It will be appreciated by those skilled in the art that the jewelry caddy 1, in its several variations, the wall caddy 62, tray caddy 46, dual compartment jewelry caddy and the single-compartment jewelry caddy 101 of this invention each offer convenient, attractive and highly functional organizers for jewelry of all types, including the facility for supporting, displaying and organizing multiple sets of clip-on earrings 28 and pierced-ear earrings 42, due to the large number of slats 33 and slat holes 37 provided in the respective slat plates 34 of the slats 33. Furthermore, while the respective jewelry caddies are each useful for organizing and displaying jewelry in the home, they may also be used to display and organize jewelry for commercial purposes, depending upon the desire of the user.

It will be further appreciated that the various jewelry caddies detailed herein may be constructed of any suitable materials known to those skilled in the art. For example, the tray 41*a* of the tray caddy 41 may be constructed of wood, "Plexiglass", metal, a resilient plastic, porcelain, glass or the like. Furthermore, the slat posts 20 and post struts 20*b* in the tray caddy 41, as well as the slat mounts 66 in the wall caddy 62 and the slat frame 21, top strut frame 16 and bottom strut frame 29 in the respective variations of the jewelry caddy 1, may be shaped of wire or rod stock having a suitable diameter. Other variations, such as the use of nylon bushings in place of the base bearing 3*a* and frame bearing 16*b*, removing the support rod 6 from the jewelry caddy 1 variation illustrated in FIG. 7 and mounting the brackets 48 directly to the top strut frame 16, and like variations can be made within the scope of the invention.

Accordingly, while the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A jewelry caddy for organizing jewelry comprising a base; an elongated support rod upward-standing from said base; a ring support mounted on the top end of said support rod; at least three struts carried by said support rod in spaced relationship with respect to said base for supporting first selected pieces of the jewelry; a top frame ring supported by said struts; a bottom frame ring spaced from said top frame ring and at least two vertical frame supports carried by said top frame ring and said bottom frame ring for joining the top frame ring to said bottom frame ring; a plurality of slats disposed around said top frame ring and said bottom frame ring; and clip means provided on said slats for removably securing said slats on said top frame ring and said bottom frame ring and supporting second selected pieces of jewelry.

2. A jewelry caddy for organizing jewelry, comprising an elongated primary support rod, a bracket rotatably carried by said primary support rod for securing said primary support rod to a vertical surface in rotatable relationship; a first strut ring carried by one end of said primary support rod and a second strut ring carried by the opposite end of said primary support rod; at least one first strut projecting from said first strut ring and at least one second strut projecting from said second strut ring, said first strut and said second strut deployed for supporting and organizing first selected pieces of the jewelry; and perforated slats removably carried by and spanning both the top frame ring and said bottom frame ring, respectively, for supporting second selected pieces of the jewelry.

3. A jewelry caddy for organizing jewelry, comprising a tray for receiving first selected piece of jewelry, a slat frame extending from said tray and at least one slat means carried by said slat frame in removeable relationship for supporting and organizing first selected pieces of jewelry; support means carried by said tray in substantially vertical relationship and a strut frame carried by said support means for receiving and organizing second selected pieces of jewelry.

4. A jewelry caddy for organizing jewelry, comprising a pair of brackets adapted for mounting on a vertical surface; a pair of slat mounts carried by said brackets in spaced, parallel relationship and a plurality of slats and at least one clip provided on each of said slats for removably securing said slats to said slat mounts for supporting and organizing selected pieces of jewelry.

5. A jewelry caddy for organizing jewelry comprising an enclosure, at least one compartment provided in said enclosure; slat frame means provided in said compartment; and slat means removably carried by said slat frame means for receiving, supporting and organizing selected pieces of jewelry.

6. A jewelry caddy of claim 5 wherein said at least one compartment further comprises two compartments, said slat frame means is disposed in one of said compartments for receiving first selected pieces of the jewelry and further comprising strut frame means provided in the other of said compartments for receiving, supporting and organizing second selected pieces of the jewelry.

7. The jewelry caddy of claim 6 further comprising at least one drawer slidably disposed in said enclosure.

8. The jewelry caddy of claim 6 wherein said slat frame means further comprises a first support rod rotatably mounted in vertical relationship in said one of said compartments and a pair of rings disposed on said first support rod and said slat means further comprises at least one perforated slat carried by said rings for receiving the first selected pieces of jewelry.

9. The jewelry caddy of claim 6 wherein said strut frame means further comprises a second support rod mounted in said second one of said compartments and at least one strut provided on said second support rod for receiving the second selected pieces of the jewelry.

10. The jewelry caddy of claim 6 wherein:

(a) said slat frame means further comprises a first support rod rotatably mounted in vertical relationship in said one of said compartments and a pair of rings disposed on said first support rod and said slat means further comprises at least one perforated slat carried by said rings for receiving the first selected pieces of jewelry; and (b) said strut frame means further comprises a second support rod mounted in said second one of said compartments and at least one strut provided on said second support rod for receiving the second selected pieces of the jewelry.

* * * * *